United States Patent [19]

Zimmerman et al.

[11] Patent Number: 5,000,153

[45] Date of Patent: Mar. 19, 1991

[54] SPORTING DEVICE FOR MAKING AND ACCURATELY THROWING SNOWBALLS

[75] Inventors: K. DeMarr Zimmerman; William J. Robbins, Jr., both of Kaysville, Utah

[73] Assignee: Sun Products International, Inc., Salt Lake City, Utah

[21] Appl. No.: 440,937

[22] Filed: Nov. 22, 1989

[51] Int. Cl.[5] ..... F41B 3/04

[52] U.S. Cl. ..... 124/5; 273/129 K

[58] Field of Search ..... 124/4, 5, 6, 7, 41 R; 273/129 K, 317, 318, 323–325

[56] References Cited

U.S. PATENT DOCUMENTS

| | | | |
|---|---|---|---|
| 1,075,041 | 10/1913 | Kirkness | 124/5 |
| 2,126,628 | 8/1938 | Fiondella | 273/323 |
| 3,108,807 | 10/1963 | Ruehle | 124/5 X |
| 3,115,129 | 12/1963 | Merriman | 124/5 |
| 3,472,217 | 10/1969 | Erickson | 124/5 |
| 3,539,186 | 11/1970 | Batten | 124/5 |
| 3,765,677 | 10/1973 | Carver | 273/323 |

*Primary Examiner*—Randolph A. Reese
*Assistant Examiner*—Jeffrey L. Thompson
*Attorney, Agent, or Firm*—Lynn G. Foster

[57] ABSTRACT

A game and sport device which can be used to repeatably mold and accurately throw snowballs as launched missiles. It comprises a hollow plastic shaft having a cup used for molding and holding a snowball at one or both ends. Snowballs are held in place by snow compacted into a series of 360° grooves inside each end cup. They are launched into flight at about the zenith of the throwing motion when the force of the throw exceeds the shear force of the snow where it is compacted into the grooves. The widest cup diameter occurs at the cup mouth and the snowballs are discharged from the device as a single mass of material. Two cups each having a different groove pattern, sizes or the like can be provided at opposite ends of the device to allow opportunity for cup selection to compensate for various snow conditions.

7 Claims, 1 Drawing Sheet

SPORTING DEVICE FOR MAKING AND ACCURATELY THROWING SNOWBALLS

FIELD OF THE INVENTION

This invention relates generally to outdoor sporting devices and particularly to devices pertaining to preparing and accurately throwing snowballs for game and sport.

PRIOR ART

The prior known art comprises teachings contained in U.S. Pat. No. 3,472,217. The cited patent discloses a game device for forming and throwing snowballs which comprises an elongated tubular, plastic hollow handle completely enclosed except at one end. The open distal end is enlarged to form a smooth-walled, closed intermediate section interconnecting the tubular handle and a larger, straight walled cylinder of uniform diameter, also with a smooth interior surface. The enclosed portion forms a closed resonant chamber which serves to maintain the snowball in the large open ended chamber until it is "whipped" into flight. The resonant chamber also provides an audible sound as a snowball exits the cylinder.

A marketed product, which bears the notation "U.S. Pat. No. 3,472,217", was sold under the name "SNO-FLING" by Tel Pro Products Canada, Ltd. This product also comprises a plastic hollow handle and is circular about the longitudinal axis. However, the handle end has an opening and a ridged grasping area for better gripping. The snowball forming distal end segment consists of a section which enlarges smoothly from the size of the tubular handle to a maximum radius some distance before the open end of the device. From the point of maximum radius, radius again decreases in diameter such that the mouth radius is smaller than the maximum radius. The sides of the snowball forming segment comprise a series of radial rib segments interrupted by axial ribs. The constricted opening at the throat is the primary restrictor which holds a snowball within the snowball forming segment until it is "whipped" into flight. The ribs permit use of thinner walls at the distal end in such a way as to retain rigidity.

In use, all prior art devices present problems. Release of the snowball is relatively uncontrollable in the device described in U.S. Pat. No. 3,472,217 as the only "grip" provided for the snowball is the smooth cylindrical wall and lower than atmospheric pressure created as the snowball moves from the forming chamber. When the aforesaid prior art devices are used, the snowball tends to either be prematurely released from the cup at the distal end or to break into several pieces as it exits from the cup. The later phenomenon appears to be caused by the constricted opening at the distal edge of the cup.

BRIEF SUMMARY AND OBJECTS OF THE INVENTION

In brief summary, this novel invention alleviates or overcomes the aforesaid problems related to forming and throwing snowballs and provides the opportunity to expand snow-throwing activity beyond a game to a sport where substantial accuracy may be attained with practice.

This invention in its presently preferred form comprises a novel distal cup comprising structure retaining positive adherence within a distal cup by a prepacked snowball even though there is little surface friction, between the inner surface of the cup and the outer surface of the snowball, and structure accommodating centrifugal release of the snowball as a single missile from the cup.

Loading the device consists of forcing snow into a distal end cup means, usually by plunging the cup into a body of accumulated snow. Once loaded, the packed snow contained in the distal cup is firmly held by engagement of the compacted snow structure with 360° radial grooves. An expert toss is initiated by rapid centrifugal motion comprising movement of wrist and arm in the direction of a target, much as one would swing a baseball bat with one hand. Due to the dynamic force required to shear the snowball from the adhering structure of snow in the radial grooves, the device provides a predictable point of release. The preformed snowball normally shears from adherence within the cup at the zenith point in the above-described motion. The released snowball has a maximum transverse dimension which is essentially the same as the diameter of the exit orifice of the distal end and is accurately released from the cup substantially intact.

However, the structural containing forces provided by snow packed into the grooves can vary based upon snow conditions comprising snow density, temperature, and depth. There is a diversity of cup sizes and shapes and groove sizes and patterns which may perform better under one set of snow conditions than another. To provide a broader scope of use with a single device, two cups each having different geometric dimensions and groove sizes and patterns can be placed one at each end of the device, providing the user with two selectable forming and throwing options.

Accordingly, it is a primary object to provide a novel snow forming and throwing device which provides for accuracy in use.

It is an important object to provide a novel snowball forming device comprising a distal cup wherein the largest inner cup diameter occurs at the distal edge of the cup.

It is a further important object to provide a novel snowball forming cup comprising 360° radial grooves which grip the snowball until a predefined centrifugal force causes the snowball to shear from the cup.

It is a fundamental object to provide a novel snow throwing device which propels a snowball substantially intact at a predictable release point.

It is a key object to provide a novel snow throwing device which has a snowball forming and discharging cup on both ends.

It is a further key object to provide a novel snowballing and throwing device with snowball forming and discharging cup on both ends comprising one cup which differs from the other cup.

It is a further basic object to provide two gripping means respectively adjacent each of two snowball forming and discharging cups on each end.

These and other objects and features of the present invention will be apparent from the detailed description taken with reference to accompanying drawings.

DETAILED DESCRIPTION OF THE ILLUSTRATED EMBODIMENTS

Figures 1, 2A, 2B, 3:
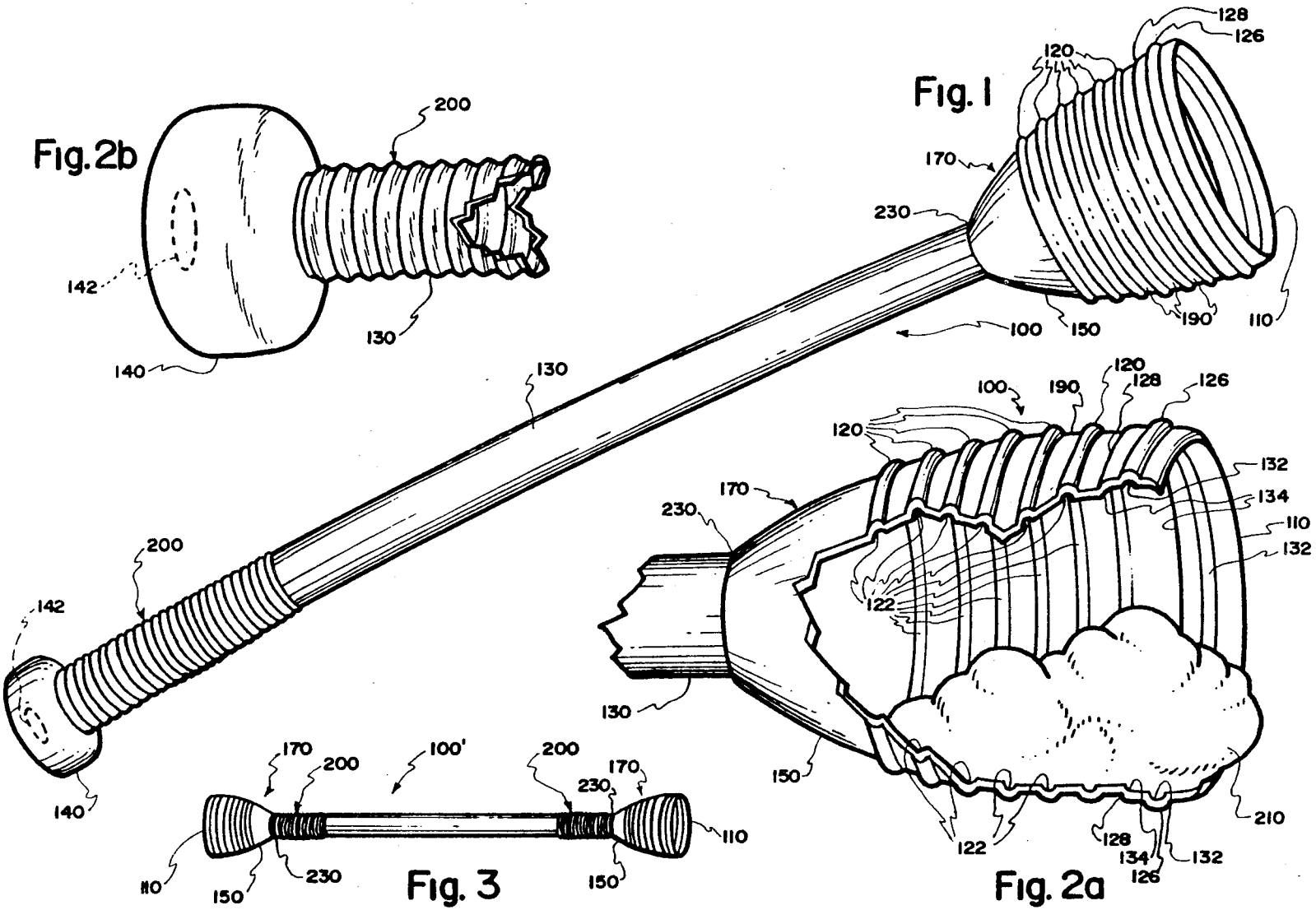
FIG. 1 is a perspective representation of one presently preferred embodiment of the invention.
FIG. 2*a* is an enlarged fragmentary perspective of the distal end cup of the embodiment of FIG. 1 with parts broken away for clarity.
FIG. 2*b* is an enlarged fragmentary perspective of the proximal end of the embodiment of FIG. 1.
FIG. 3 is a perspective representation of a second embodiment of the present invention comprising a snowball forming and discharging cup on both ends.

In this description, the term proximal is used to indicate the segment of a device normally closest to the operator when it is being used. The term distal refers to the other end. Reference is now made to the embodiments illustrated in FIGS. 1, 2*a*, 2*b* and 3 wherein like numerals are used to designate like parts throughout. As seen in FIG. 1, the snowball forming and throwing device, generally designated device 100, is elongated and tubular and comprises a snowball forming and throwing distal cup and proximal knob 140 with an adjacent handle gripping surface, generally designated 200. Device 100 preferably comprises a suitable synthetic resinous material such as polyethylene. Device 100 is symmetrical along the longitudinal axis thereof. While it is currently formed as one piece using known blow molding techniques it could be made by bonding two nearly identical semicircular injection molded halves together. Also, other suitable manufacturing techniques can be employed.

Referring to the proximal end, knob 140 is a bulbous hollow cylindrical part which functions as a positive stop for the user's hand at the proximal end of serrated gripping surface 200. The most proximal end of knob 140 turns inward to form the edge 142 of a medial hole. Gripping surface 200 is formed by a series of raised ridges separated by grooves in the shaft of device 100 and is preferably of sufficient length that it will extend at least across the breadth of the largest hand.

Hollow tube 130 extends between the proximal end at knob 140 and a distal end cup 170 and constitutes most of the length of the throwing device 100.

As illustrated in FIG. 2, distal end cup 170 comprises a hollow bell-shaped receptacle 150 and a snow ingress and egress distal mouth 110. Snow receptacle 150 comprises a series of smooth surface segments 190 periodically interrupted by evenly spaced radially directed outwardly projecting 360° ridges 120. The receptacle 150 encloses a volume, the cross sectional area of which continuously increases from the line of contact 230 with shaft 130 to the mouth 110 of cup 150. However, the rate of increase of cross sectional area decreases as the distance from mouth 110 decreases until the rate of increase near mouth 110 is zero. Thus, no other part of the receptacle 150 has a diameter greater than the diameter of the mouth 110 and, in the illustrated embodiment of FIGS. 1, 2*a* and 2*b*, all other parts of the receptacle 150 have diameters less than the diameter of mouth 110.

Ridges 120 extend annularly around the outside of receptacle 150 forming annular raised rings above smooth surface segments 190. The inside surface of the wall defining the receptacle 150 comprises grooves 122. From ridge 128 to mouth 110, the diameter may be slightly enlarging or constant except for the ridge 126 which is superimposed centrally upon ridge 128. Ridges 128 and 126 form inside grooves 134 and 132, respectively. When a snowball 210, shown in the beginning of its formation in FIG. 2, is packed into receptacle 150, compressed snow fills grooves 122, 134, and 132. Under packed conditions, the snow in filled grooves 122 is held by compaction to the surrounding snow in the receptacle 150 to form a solid mass which resists inadvertent displacement from the cup 170. Before the snowball 210 can be flung or launched from the cup 170, the snow in filled grooves 220 must be sheared from the remainder of the snowball. It is the shearing force required to remove snowball 210 from cup 170 which constrains snowball 210 in cup 170 until the zenith of the throw and as the device is brought to a rapid stop whereat conservation of momentum causes the snowball to be discharged from cup 170 at mouth 110.

Another preferred embodiment is illustrated in FIG. 3. In this case, device 100' comprises a distal cup 170 at each end. Each cup 170 comprises a receptacle 150 and cup mouth 110 as earlier explained. No end knob is used. A gripping surface 200 is disposed immediately central of each cup 170 such that the device may be operated from either end. The two cups 170 may be sized and shaped differently but within the scope of the present invention.

Number, placement and size of grooves 122, 132, and 134 can be varied to produce receptacles 150 having different discharge characteristics. These different discharge characteristics can be profitably applied to snow which packs differently under varying snow conditions comprising temperature, density, depth, and water content.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A sporting device, having a central longitudinal axis, for forming and throwing snowballs comprising:

straight tubular, plastic shaft means comprising integral proximal end manual grasping means for holding and swinging the device;

the device further comprising bulb-shaped cup means integrally disposed at the distal end of the device, the distal end bulb-shaped cup means forming continuously distally divergently tapered bulb-shaped receptacle means comprising wall means which have a continuously increasing transverse dimension in a distal direction and which receptacle means terminate in a distal end portion thereof comprising an opening accommodating ingress and egress of snow, the average transverse dimension at the distal end portion of the receptacle means comprising the maximum average transverse dimension of the cup means;

the wall means further comprising a plurality of grooves formed at the inside surface of said wall means, each groove being radially spaced from the longitudinal axis and extending in a circumferential direction.

2. A sporting device, having a central longitudinal axis, for forming and throwing snowballs with greater accuracy comprising:

hollow shaft means integral with end means comprising grasping means for gripping, holding and swinging the device and distal end bulb-shaped means comprising bulbously-tapered snow receptacle means and snow ingress and egress means at a distal end for forming and dispensing snowballs;

the receptacle means comprising bulbously-tapered wall means which have a continuously increasing transverse dimension in a distal direction and define a plurality of interior radially enlarged grooves radially spaced from the longitudinal axis and extending circumferentially through 360 degrees which grooves provide substantial adhesion between the device and packed snow therein wherein the average transverse dimension of the receptacle means is maximum at the distal end.

3. A sporting device for forming and throwing snowballs according to claim 2 wherein the device comprises synthetic resinous material which has non-wettable characteristics whereby the force of adherence of the snowball is substantially provided by snow compacted into said grooves.

4. A sporting device for forming and throwing snowballs according to claim 3 wherein said synthetic resinous material comprises polyethylene.

5. A multi-use sporting device, having a central longitudinal axis, for forming and throwing snowballs comprising:

elongated tubular means comprising proximal end means and distal end means;

each end means forming cup means comprising receptacle means comprising wall means having a radius which is orthogonal to the shaft and which generally increases towards the extremity of each end;

radially enlarged interior groove means radially spaced from the longitudinal axis and extending circumferentially through 360 degrees which provide positive gripping surfaces for receipt of compacted snow whereby either cup means may be selectively used with equal facility;

gripping surface means disposed at the exposed surface of the elongated tubular means juxtaposed each receptacle means.

6. A multi-use sporting device for forming and throwing snowballs according to claim 5 wherein.

the two receptacle means are not identical whereby either receptacle may be selected for use depending on existing snow conditions such as temperature, water content, compaction, and depth.

7. A sporting device, having a central longitudinal axis, for forming and throwing snowballs comprising:

a substantially straight hollow plastic tube comprising a grasping area for gripping, holding and swinging the device at or near one end of the device and a bulb-shaped cup disposed at the other end of the device in which snowballs are formed and discharged;

an end knob disposed adjacent to the grasping areas having aperture means in communication with the hollow of the tube;

the bulb-shaped cup comprising a receptacle enclosing a volume and a diameter which continuously increases in a distal direction along the entire length of the receptacle, the rate of change of which decreases to a minimum at the distal end of the receptacle;

interior enlarged spaced grooves radially spaced from the longitudinal axis and extending circumferentially, the grooves disposed at the inside of said receptacle which provide temporary adherence between packed snow and the inside surface of the receptacle.

* * * * *